US011401715B2

(12) United States Patent
Mikdad et al.

(10) Patent No.: US 11,401,715 B2
(45) Date of Patent: Aug. 2, 2022

(54) CONCRETE CONSTRUCTION ELEMENT AND REINFORCEMENT ARRANGEMENT, ESPECIALLY FOR A CONCRETE CONSTRUCTION ELEMENT

(71) Applicant: Halfen GmbH, Langenfeld (DE)

(72) Inventors: Fadi Mikdad, Langenfeld (DE); Dirk Albartus, Bochum (DE); Frank Häusler, Düsseldorf (DE); Dieter Plamper-Hellwig, Haan (DE)

(73) Assignee: Leviat GmbH, Langenfeld (DE)

( * ) Notice: Subject to any disclaimer, the term of this patent is extended or adjusted under 35 U.S.C. 154(b) by 0 days.

(21) Appl. No.: 17/106,455

(22) Filed: Nov. 30, 2020

(65) Prior Publication Data

US 2021/0180323 A1 Jun. 17, 2021

(30) Foreign Application Priority Data

Dec. 11, 2019 (DE) ..... 20 2019 005 047.7

(51) Int. Cl.
*E04C 5/06* (2006.01)
*E04C 2/06* (2006.01)

(52) U.S. Cl.
CPC ..... *E04C 5/0604* (2013.01); *E04C 2/06* (2013.01)

(58) Field of Classification Search
CPC .. E04C 5/0604; E04C 2/06; E04B 2001/4192; E04B 1/4107; E04B 1/41; E04B 1/00
See application file for complete search history.

(56) References Cited

U.S. PATENT DOCUMENTS

2020/0173164 A1 6/2020 Gstach et al.
2020/0232206 A1 7/2020 Gstach et al.

FOREIGN PATENT DOCUMENTS

| | | | | |
|---|---|---|---|---|
| DE | 20203262 | | 7/2003 | |
| EP | 3438362 | A1 * | 2/2019 | ..... E04B 1/4107 |
| WO | 2009/083002 | | 7/2009 | |
| WO | WO-2014088913 | A1 * | 6/2014 | ..... E04G 11/365 |

* cited by examiner

*Primary Examiner* — Patrick J Maestri
(74) *Attorney, Agent, or Firm* — Gudrun E. Huckett

(57) ABSTRACT

A concrete construction element has a concrete base body with at least one flat side and an end face. An anchor rail is embedded in the concrete base body. A reinforcement component is provided that has a plate embedded in the concrete base body at a side of the anchor rail which is facing toward the end face of the concrete base body. The reinforcement component has two anchors fixedly connected to the plate, wherein the two anchors extend away from the plate to a side of the anchor rail which is facing away from the plate. The two anchors each have an end facing away from the plate, wherein the end has an anchoring section, wherein the anchoring section forms an undercut in a direction toward the plate.

13 Claims, 5 Drawing Sheets

CONCRETE CONSTRUCTION ELEMENT AND REINFORCEMENT ARRANGEMENT, ESPECIALLY FOR A CONCRETE CONSTRUCTION ELEMENT

BACKGROUND OF THE INVENTION

The invention relates to a concrete construction element comprising a concrete base body, at least one anchor rail embedded in the concrete base body and at least one reinforcement component, wherein the concrete base body comprises at least one flat side and an end face, wherein the reinforcement component comprises a plate which is embedded in the concrete base body at a side of the anchor rail that is facing toward the end face of the concrete base body, wherein the reinforcement component comprises at least two anchors which are fixedly connected to the plate and which extend away from the plate to the side of the anchor rail facing away from the plate.

The invention further relates to a reinforcement arrangement in particular for a concrete construction element, comprising an anchor rail with at least one rail anchor and a reinforcement component, wherein the reinforcement component comprises a plate and at least two anchors, wherein the plate extends at a distance from the anchor rail.

US 2020/0232206 discloses a concrete construction element with an anchor rail and an edge reinforcement. The edge reinforcement is formed by a plate which is arranged at the end face of the construction body. A plurality of anchoring rods are secured to the plate. The anchoring rods extend below the anchor rail away from the plate to the side of the anchor rail facing away from end face of the construction body.

The invention has the object to provide a concrete construction element of the aforementioned kind with improved edge reinforcement.

A further object of the invention resides in providing a reinforcement arrangement, in particular for a concrete construction element.

SUMMARY OF THE INVENTION

In accordance with the invention, the object is achieved in regard to the concrete construction element in that the anchors at their ends facing away from the plate each comprise at least one anchoring section which forms an undercut in the direction toward the plate.

In accordance with the invention, the object is achieved in regard to the concrete construction element furthermore in that the anchor rail comprises an interior and the at least one anchor, in a viewing direction in a longitudinal direction of the anchor rail, covers the interior of the anchor rail at least partially.

In accordance with the invention, the object is achieved in regard to the concrete construction element furthermore in that the reinforcement component and the anchor rail are configured together as one piece.

In regard to the reinforcement arrangement, the object is solved in that the plate together with at least two anchors is formed as one piece.

Thus, in order to provide an improved edge reinforcement, it is provided that the anchors at their ends facing away from the plate each comprises at least one anchoring section which, in the direction toward the plate, forms an undercut. Such an undercut improves anchoring of the anchoring sections in the surrounding concrete. In this way, by means of the plate connected to the anchors, greater forces can be transmitted so that the edge reinforcement is improved. In this way, higher transverse forces can be absorbed by the anchor rail and the surrounding concrete. In this context, the at least one anchoring section forms an undercut in particular in the direction toward the end face of the concrete base body.

A simple configuration of the reinforcement component is provided when the plate and at least two anchors are formed together as one piece. The plate and the at least two anchors are accordingly manufactured monolithically from a common base material. In this way, the manufacture is simplified because no separate connections between the at least two anchors and the plate must be produced. In a particularly advantageous configuration, the anchors with the anchoring sections are formed of flat material, in particular together with the plate. In this way, a simple cost-efficient manufacture of the anchors, in particular of the entire reinforcement component, as a bent sheet metal part is possible.

As an alternative or as a supplement to the configuration with at least one anchoring section provided with an undercut, it is advantageously provided that the at least one anchor, in viewing direction in longitudinal direction of the anchor rail, covers an interior of the anchor rail at least partially. This constitutes an independent inventive concept which is independent of the formation of an undercut provided by the anchoring sections. In contrast to the prior art, the at least one anchor does not extend below the back of the anchor rail. Instead, the at least one anchor extends along an end face of the anchor rail and covers the end face of the anchor rail at least partially. In this way, a good force introduction from the anchor rail into the at least one anchor is made possible. At the same time, the overall size of the anchor rail and of the at least two anchors is reduced. In this way, in particular the installation in a concrete construction element with additional reinforcement is facilitated. When manufacturing the concrete construction element, the reinforcement component is preferably placed onto a reinforcement of the concrete construction element or secured to the additional reinforcement or to a formwork.

Particularly preferred, two anchors are provided which extending at one end of the anchor rail, respectively. In this way, the anchor rail is safely anchored at its ends in the surrounding concrete so that in particular transverse forces can be distributed well into the surrounding concrete.

Particular preferred, the anchors are fixed at the ends of the anchor rail. In this way, the plate, the anchor rail, and the sections of the anchors connecting the plate and the anchor rail form a closed frame; this closed frame clamps the concrete arranged therebetween and enables thus a good force introduction and avoids that concrete chips off between anchor rail and end face of the concrete construction element.

The anchor rail comprises advantageously a longitudinal side which is facing the plate. In viewing direction perpendicular to the longitudinal side, the plate covers the anchor rail advantageously across at least 50%, in particular across at least 80%, of the length of the anchor rail at least partially. In a particularly preferred configuration, the plate covers the anchor rail across at least 50%, in particular across at least 80%, of the length of the anchor rail across at least 50% of the height, in particular across the entire height, of the rail base body of the anchor rail.

The anchor rail comprises advantageously a rail base body and at least one rail anchor secured thereat. The plate covers the rail base body in viewing direction perpendicular to the longitudinal side of the anchor rail advantageously across at least 50%, in particular across at least 80%, of the height of the rail base body. The overlap of the rail base body and the plate across at least 50% of the height of the rail base body exists in this context at least across a portion of the length of the rail base body, in particular across at least 50%, preferably across at least 80%, of the length of the anchor rail.

Particularly advantageously, the plate covers at least partially the at least one rail anchor in viewing direction perpendicular to the longitudinal side of the anchor rail. In an advantageous configuration, it is provided that the plate covers at least partially the at least one anchoring section in viewing direction perpendicular to the longitudinal side of the anchor rail. It has been found that by the overlap in the viewing direction perpendicular to the longitudinal side of the anchor rail, i.e., in transverse direction of the anchor rail, a beneficial force distribution is enabled, in particular for transverse forces introduced into the anchor rail.

In order to achieve a good edge reinforcement, it is advantageously provided alternatively or additionally that the reinforcement component and the anchor rail are formed together as one piece. The one piece configuration of reinforcement component and anchor rail constitutes an independent inventive concept which is independent of additional configurational features. The reinforcement component and the anchor rail are therefore fixedly and stably connected to each other. For example, the reinforcement component can be welded to the anchor rail, in particular by spot welds. A different type of attachment of reinforcement component and anchor rail may be advantageous also. Due to the one piece configuration, the reinforcement component and the anchor rail can be positioned as a unitary component. In this way, the manufacture of the concrete construction element is simplified. The reinforcement component, in particular the plate, provides a positioning aid for the anchor rail. When the plate is positioned at the end face or at a predetermined minimal distance from the end face, the anchor rail is forcibly positioned at a predetermined distance from the end face of the concrete construction element. The reinforcement component and the anchor rail are not connected exclusively by means of the surrounding concrete but, already prior to pouring the surrounding concrete, are connected in a fixed and permanent way to each other. Forces that are occurring between anchor rail and reinforcement component can therefore be transmitted directly and without intermediate action of the concrete. Therefore, great forces can be reliably transmitted.

In order to achieve a good introduction of forces into the surrounding concrete and to avoid that concrete chips off in the edge region of the concrete construction element, it is advantageously provided that the plate is embedded at a distance of less than 20 mm from the end face in the concrete construction element. In a particularly advantageous configuration, the plate is positioned immediately at the end face. The longitudinal direction of the plate extends advantageously parallel to the longitudinal direction of the anchor rail. The plate and the anchor rail extend advantageously at a distance from each other. Particularly preferred, the plate does not project in longitudinal direction of the plate past the anchor rail. In this way, the plate can pass with a bend into the anchors so that no edges are produced and therefore also no force peaks for introduction of forces into the concrete are generated. The at least one anchor extends preferably perpendicularly to the plate and the end face of the concrete construction element.

For a reinforcement arrangement for a concrete construction element, it is provided that the reinforcement arrangement comprises an anchor rail with at least one rail anchor secured thereat and further comprises a reinforcement component. The reinforcement component comprises a plate and at least two anchors. The plate extends at a distance from the anchor rail. A simple manufacture and handling of the reinforcement arrangement can be achieved in that the plate and the at least two anchors are formed together as one piece. The plate and the at least two anchors can be embodied in particular as a bent sheet metal part in this context. In this way, a simple manufacture is enabled.

In an advantageous embodiment, it is provided that the reinforcement component comprises at least one additional anchor which is fixed to the plate. The additional anchor which is provided in addition to the two anchors provided at the ends of the anchor rail extends advantageously at the back of the anchor rail and extends parallel to the anchors extending at the ends of the anchor rail. The at least one additional anchor also comprises advantageously an anchoring section.

The longitudinal direction of the plate extends advantageously parallel to the longitudinal direction of the anchor rail in viewing direction perpendicular to a longitudinal side of the anchor rail. In a particularly advantageous embodiment, the longitudinal direction of the anchor rail and the longitudinal direction of the plate are aligned parallel to each other.

BRIEF DESCRIPTION OF THE DRAWINGS

Embodiments of the invention will be explained in the following with the aid of the drawings.

DESCRIPTION OF PREFERRED EMBODIMENTS

Figure 1:
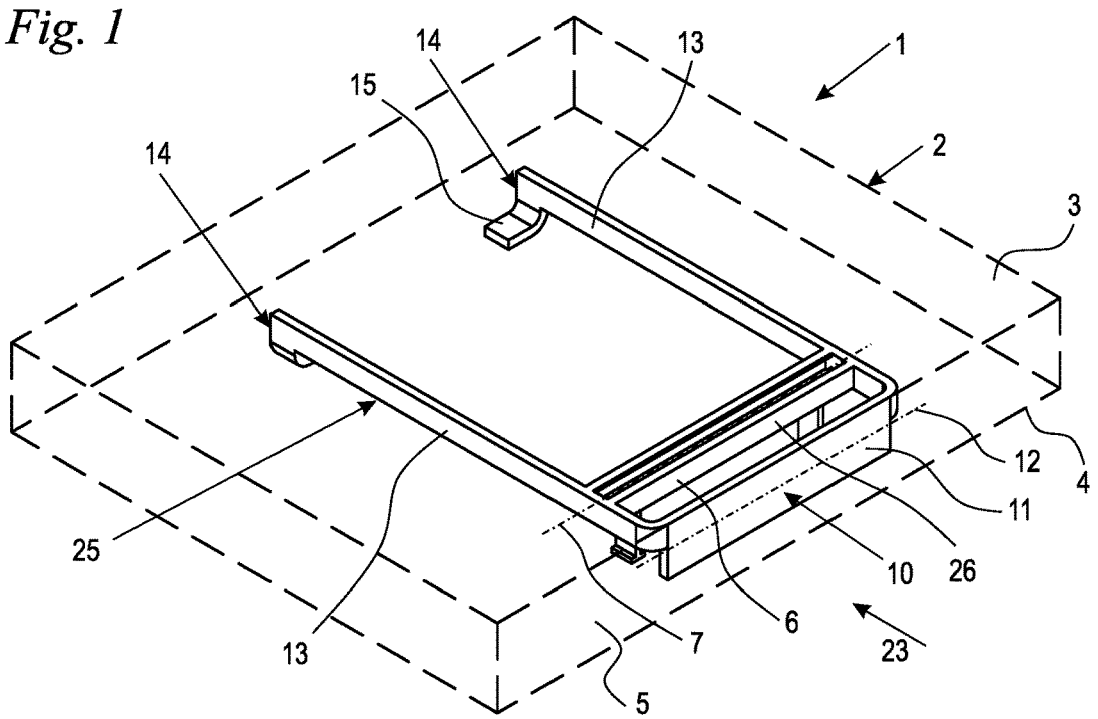
FIG. 1 is a schematic perspective illustration of a concrete construction element.

FIG. 1 shows a concrete construction element 1 in perspective illustration. The concrete construction element 1 comprises a concrete base body 2 in which a reinforcement arrangement 25 is embedded. The concrete base body 2 is illustrated transparent for better clarity and illustrated by dashed lines while the reinforcement arrangement 25 is illustrated in solid lines. The concrete base body 2 comprises two flat sides 3 and 4 positioned opposite each other. In the embodiment, the flat side 3 is the top side of the concrete base body 2 and the flat side 4 is the bottom side. An end face 5 of the concrete base body 2 is extending between the flat sides 3 and 4.

The reinforcement arrangement 25 which is embedded in the concrete base body 2 comprises an anchor rail 6 as well as a reinforcement component 10. In the embodiment, the anchor rail 6 and the reinforcement component 10 are embodied together as one piece. The anchor rail 6 and the reinforcement component 10 are therefore connected to each other in a load-bearing way, in particular non-detachably, to each other. The load-bearing, fixed connection between anchor rail 6 and reinforcement component 10 can be, for example, a weld connection, in particular a spot weld connection.

The reinforcement component 10 comprises a plate 11 and two anchors 13 which are fixedly connected to the plate 11. In the embodiment, the plate 11 and the anchors 13 are arranged flush in relation to the flat side 3 in the concrete base body 2. In an advantageous configuration, precisely two anchors 13 are provided. The plate 11 comprises a longitudinal direction 12 which extends parallel to the end face 5. The plate 11 is advantageously embedded at a distance of less than 20 mm from the end face 5 in the concrete base body 2. The plate 11 is arranged in the embodiment immediately adjacent to the end face 5 and without a distance from the end face 5. The anchor rail 6 comprises a longitudinal direction 7. The longitudinal direction 7 of the anchor rail 6 and the longitudinal direction 12 of the plate 11 extend parallel to each other and at a distance from each other, as shown in FIG. 1. The anchor rail 6 comprises a longitudinal side 26 which is facing the plate 11. The longitudinal side 26 extends at a distance from the plate 11.

At their ends 14 facing away from the plate 11, the anchors 13 comprise anchoring sections 15. In the embodiment according to FIG. 1, the anchoring sections 15 are embodied as sections of the anchors 13 which are bent toward each other. In the embodiment, the anchors 13 are approximately L-shaped. The short legs of the anchors 13 are bent and form the anchoring sections 15. The anchoring sections 15 each form an undercut in the direction toward the plate 11 or in the direction toward the end face 5 of the concrete base body 2. Herein, the term "undercut" means that, in the direction perpendicular to the end face 5 or in the direction toward the plate 11, concrete is located between the anchoring sections 15 and the end face 5.

Figure 2:
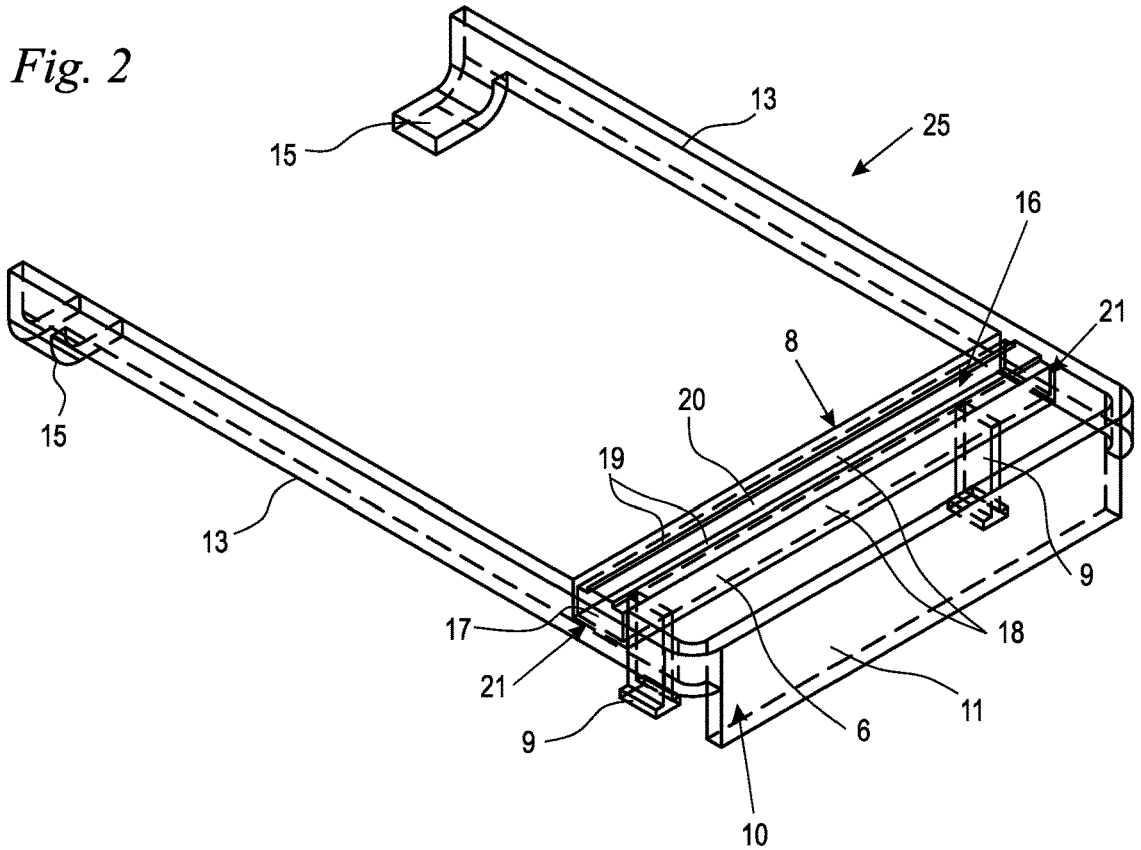
FIG. 2 is a perspective illustration of the reinforcement arrangement of the concrete construction element of FIG. 1.

FIG. 2 shows the configuration of the reinforcement arrangement 25 in detail. As shown in FIG. 2, the anchor rail 6 comprises a rail base body 8. The rail base body 8 comprises two side walls 18 and a back 17 connecting the side walls 18. In the embodiment, the side walls 18 extend parallel to each other. At the side walls 18, rail lips 19 are arranged at the longitudinal side which is facing away from the back 17. The two rail lips 19 projects toward each other and delimit a longitudinal slot 20. Through the longitudinal slot 20, elements that are to be secured at the anchor rail 6, for example, fastening screws, can be inserted into an interior 16 of the anchor rail 6 and can be fixed behind the rail lips 19. The interior 16 is delimited by the back 17, the two side walls 18, and the two rail lips 19.

The anchor rail 6 comprises two ends 21. At each end 21, one of the anchors 13 is fixed. As shown in FIG. 2, rail anchors 9 of the anchor rail 6 are provided at the back 17 of the anchor rail 6. In the embodiment, two rail anchors 9 are provided which are arranged between the ends 21.

Figure 3:
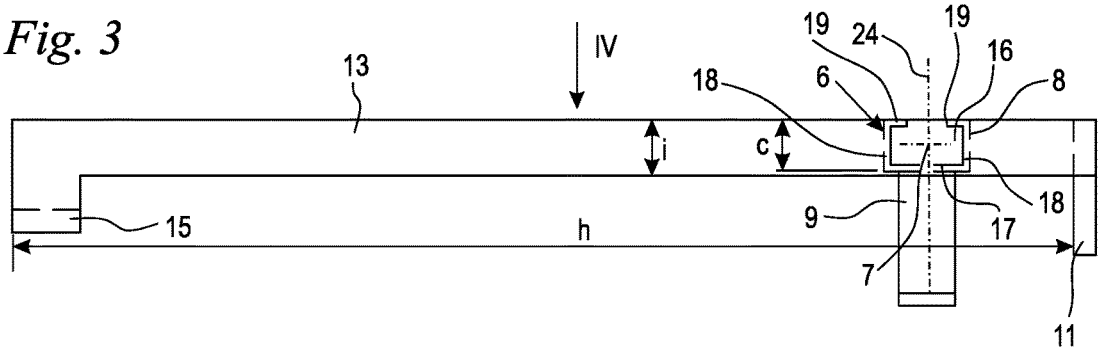
FIG. 3 is a side view of the reinforcement arrangement of FIG. 2.

FIG. 3 shows the configuration of the anchor rail 6 comprised of rail back 17, side walls 18, and rail lips 19 in detail. The anchors 13 are arranged flush with the rail lips 19. At the side of the reinforcement arrangement 25 which is neighboring the flat side 3 in the installation state, the anchors 13 pass also flush into the plate 11. As also shown in FIG. 3, the rail anchors 9 in the embodiment are designed as flat anchors which extend across most of the width of the anchor rail 6. A different configuration of the rail anchors 9 can also be advantageous.

The longitudinal direction 7 of the anchor rail 6 is positioned in a center plane 24. The center plane 24 extend centrally between the side walls 18 of the anchor rail 6. The center plane 24 extends parallel to the plane of the end face 5 (FIG. 1). As shown in FIG. 3, the plate 11 and the anchoring sections 15 are arranged on opposite sides of the center plane 24. The center plane 24 extends parallel to the longitudinal side 26.

The anchors 13 comprise a length h which is measured perpendicularly to the end face 5 or perpendicularly to the center plane 24. The rail base body 8 of the anchor rail 6 comprises a height c which is measured perpendicularly to the longitudinal direction 7 and parallel to the center plane 24. The anchors 13 comprise a height i which is measured parallel to the center plane 24 and perpendicularly to the longitudinal direction 7. The height i is measured between the plate 11 and the anchoring sections 15 in this context. In the region of the anchoring sections 15, the anchors 13 can have a larger height. The height i corresponds advantageously to at least 80%, preferably at least 100%, of the height c. In the embodiment, the height i is greater than the height c. The plate 11 comprises a height d (FIG. 5) which is measured parallel to the center plane 24 and perpendicularly to the longitudinal direction 7. The height d is larger than the height i of the anchors 13 and larger than the height c of the rail base body 8 of the anchor rail 6. The anchor rail 6 comprises a total height m corresponding to the total height of the reinforcement arrangement 25. The total height m in the embodiment is greater than the height d of the plate 11.

Figure 4:
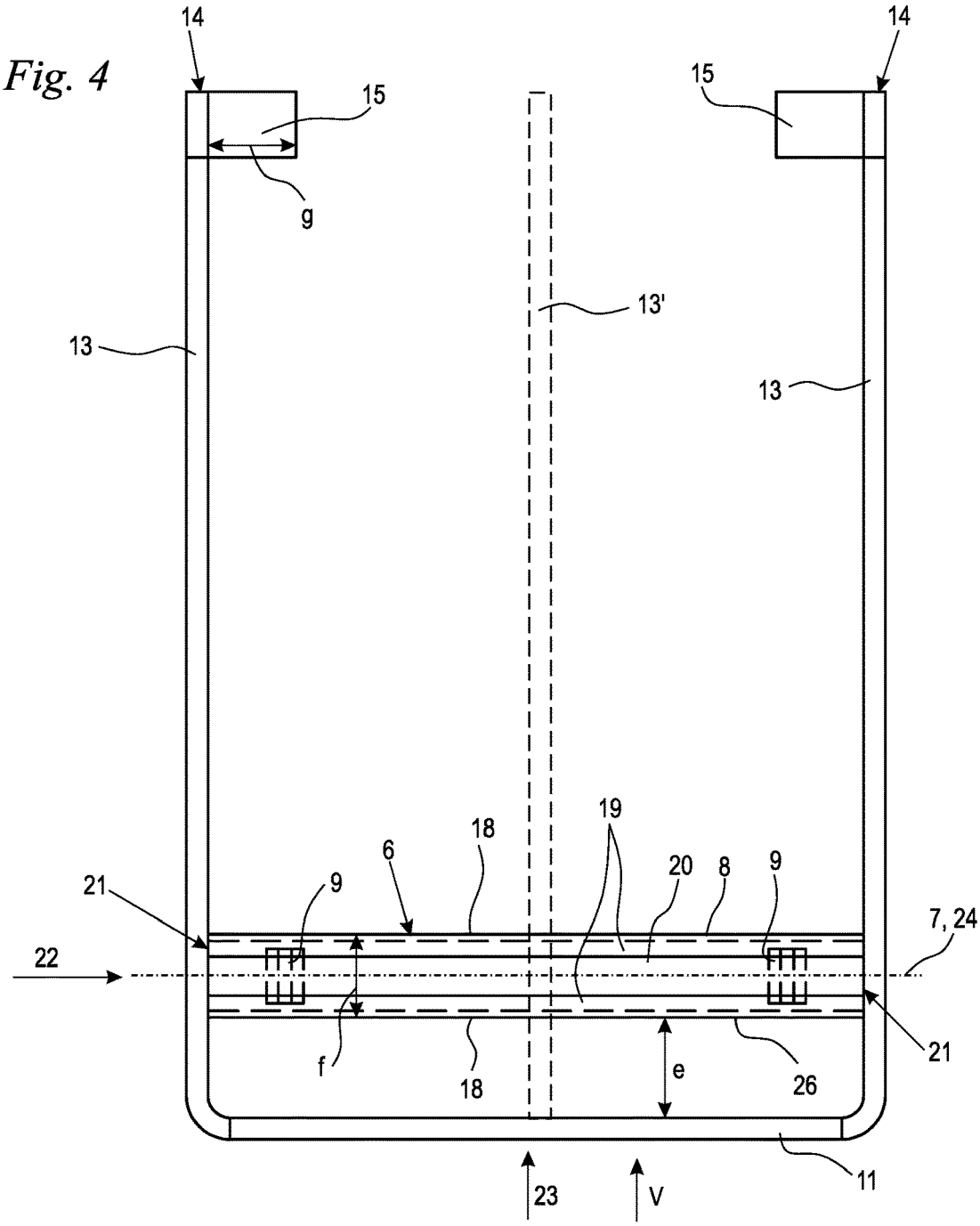
FIG. 4 is a side view of the reinforcement arrangement viewed in the direction of arrow IV in FIG. 3.

In FIG. 4, the reinforcement arrangement 25 is illustrated in a plan view in a direction perpendicular to the flat side 3 of the concrete construction element 1 (FIG. 1). As shown in FIG. 4, the anchor rail 6 comprises a width f which is measured perpendicularly to the longitudinal direction 7 and perpendicularly to the end face 5 (FIG. 1). The distance e which is measured in the same direction between the anchor rail 6 and the plate 11 amounts advantageously to at least 20% of the width f. Particularly preferred, the distance e amounts to 50% to 500% of the width f. The plate 11, the anchor rail 6, and the sections of the anchors 13 extending between the plate 11 and the ends 21 of the anchor rail 6 form together a closed frame. The anchor rail 6, the plate 11, and the sections of the anchors 13 extending between the plate 11 and the ends 21 of the anchor rail 6 frame the region of the concrete base body 2 between anchor rail 6 and plate 11 and introduce the external forces via the anchors 13 and the anchoring elements 15 into the surrounding concrete of the concrete base body 2. As also shown in FIG. 4, the anchoring sections 15 have a width g. The width g corresponds in this context to the projection by means of which the anchoring sections 15 project past the inner sides of the anchors 13 which are facing each other. Advantageously, the width g amounts to 20% to 300% of the width f of the rail base body 8 of the anchor rail 6. The length h of the anchors 13 (FIG. 3) amounts to a multiple of the width f of the anchor rail 6. Advantageously, the length h amounts to at least 5 times, preferably at least 10 times, the width F.

In FIG. 4, a viewing direction 22 in the longitudinal direction 7 of the anchor rail 6 as well as a viewing direction 23 perpendicular to the longitudinal side 26 of the anchor rail 6 or of the end face 5 (FIG. 1) are illustrated. The view in the viewing direction 22 is illustrated in FIG. 3. As shown in FIG. 3, the anchors 13 completely cover the ends 21 (FIG. 4) of the anchor rail 6 in the viewing direction 22. The anchors 13 cover the interior 16 of the anchor rail 6 in the viewing direction 22 at least partially, in particular completely.

Figure 5:
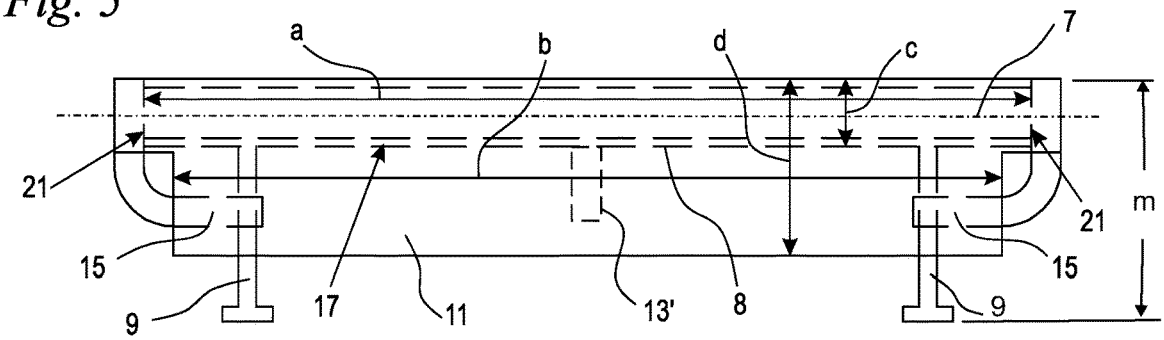
FIG. 5 is a side view of the reinforcement arrangement viewed in the direction of arrow V in FIG. 4.

FIG. 5 shows the reinforcement arrangement 25 in viewing direction 23 (FIG. 4). As shown in FIG. 5, the plate 11 covers the anchoring sections 15 in the viewing direction 23 at least partially. The rail anchors 9 are also covered in viewing direction 23 at least partially by the plate 11. The plate 11 comprises a length b measured in longitudinal direction 7. As also shown in FIG. 5, the plate 11 covers the anchor rail 6 across the entire length b of the plate 11. In the embodiment, the length b is smaller than a length a of the anchor rail 6 measured in the same direction. The length b amounts advantageously to at least 50%, in particular at least 80%, of the length a. The height d of the plate 11 is in the embodiment greater than the height c of the rail base body 8. The height d amounts advantageously to at least 50%, in particular 80% to 400%, of the height c. In the viewing direction 23 perpendicular to the end face 5, the plate 11 covers the rail base body 8 advantageously across at least 50% of the height c of the rail base body 8, preferably across at least 80% of the height c of the rail base body 8.

In the embodiment, the plate 11 and the anchors 13 are embodied together as one piece. Advantageously, the plate 11 and the anchors 13 are made of flat material. The plate 11 can be formed together with the anchors 13, for example, as a bent sheet metal part. The anchor rail 6 is connected fixedly to the anchors 13. For this purpose, the anchors 13 are fixed to the ends 21 of the anchor rail 6, for example, by welding. A one-piece monolithic configuration of the plate 11, the anchors 13, and the anchor rail 6 can be provided also.

In viewing direction 23 perpendicular to the longitudinal side 26 and the end face 5, the plate 11 at least partially covers the anchor rail 6 advantageously across at least 50%, in particular at least 80%, of the length a of the anchor rail.

In addition to the anchors 13 which are extending at both ends 21 of the anchor rail 6, the reinforcement arrangement 25 can comprise at least one additional anchor 13'. In FIGS. 4 and 5, such an anchor 13' is schematically illustrated. In the embodiment, the anchor 13' extends from the plate 11 parallel to the anchors 13 and centrally between the anchors 13. The anchor 13' extends in this case at the back 17 of the anchor rail 6 past the anchor rail 6.

Figure 6:
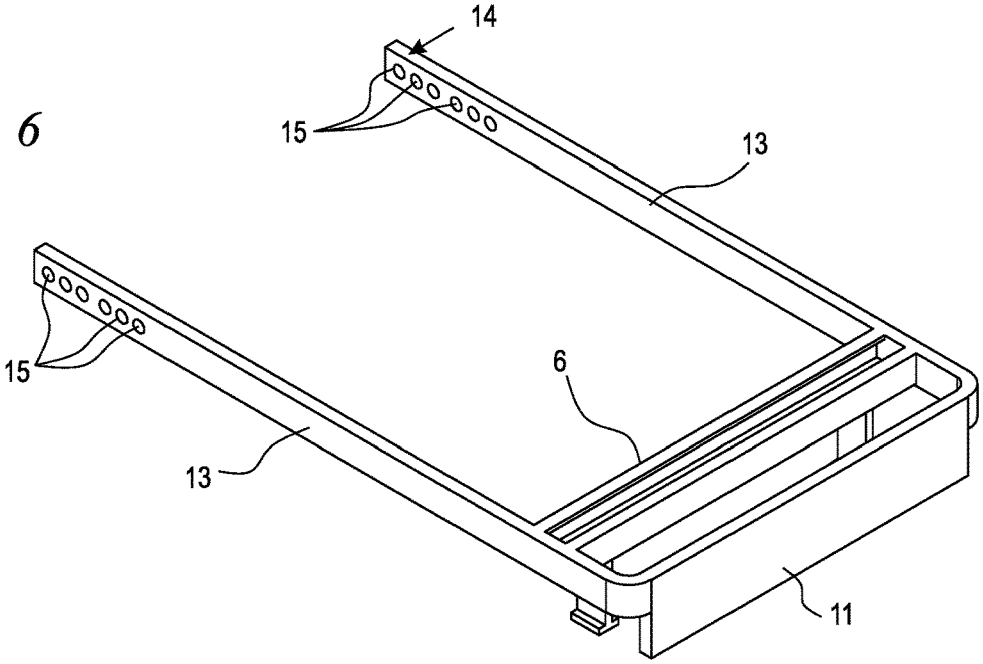
FIG. 6 is a perspective illustration of a further embodiment of the reinforcement arrangement.
Figure 7:
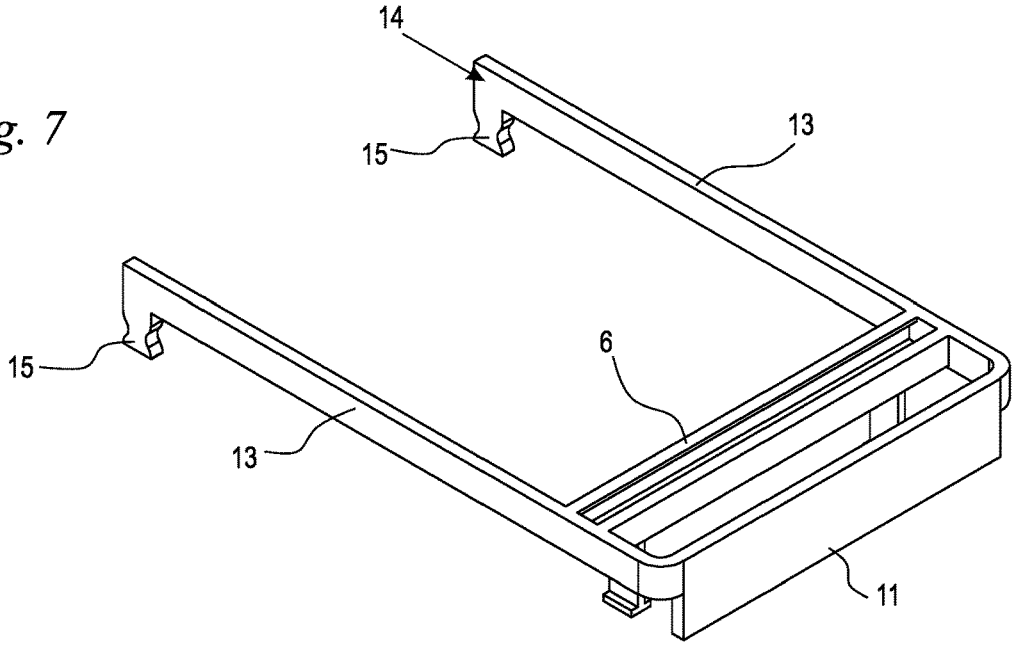
FIG. 7 is a perspective illustration of another embodiment of the reinforcement arrangement.

FIGS. 6 and 7 show alternative embodiments for anchoring sections 15. The configuration of the other parts of the reinforcement arrangements 25 illustrated in FIGS. 6 and 7 corresponds to the configuration illustrated in FIGS. 1 to 5. In the embodiment according to FIG. 6, the anchors 13 comprise, adjacent to their ends 14, anchoring sections 15 which are designed as openings. In the embodiment, the openings which form the anchoring sections 15 project in this context completely through the anchors 13. The side walls of the openings which form the anchoring sections 15 form undercuts in the direction toward the end face 5 (FIG. 1). Concrete which is arranged in the anchoring sections 15 improves the anchoring of the anchors 13 in the surrounding concrete.

In the embodiment according to FIG. 7, anchoring sections 15 are provided which extend transversely to the longitudinal direction of the anchors 13 in the same plane. In this way, the anchors 13 are approximately of an L-shaped configuration. The anchoring sections 15 are each provided in the embodiment with a constriction which effects a further improvement of anchoring in the surrounding concrete.

A different configuration of the anchoring sections 15 can also be advantageous.

Figure 8:
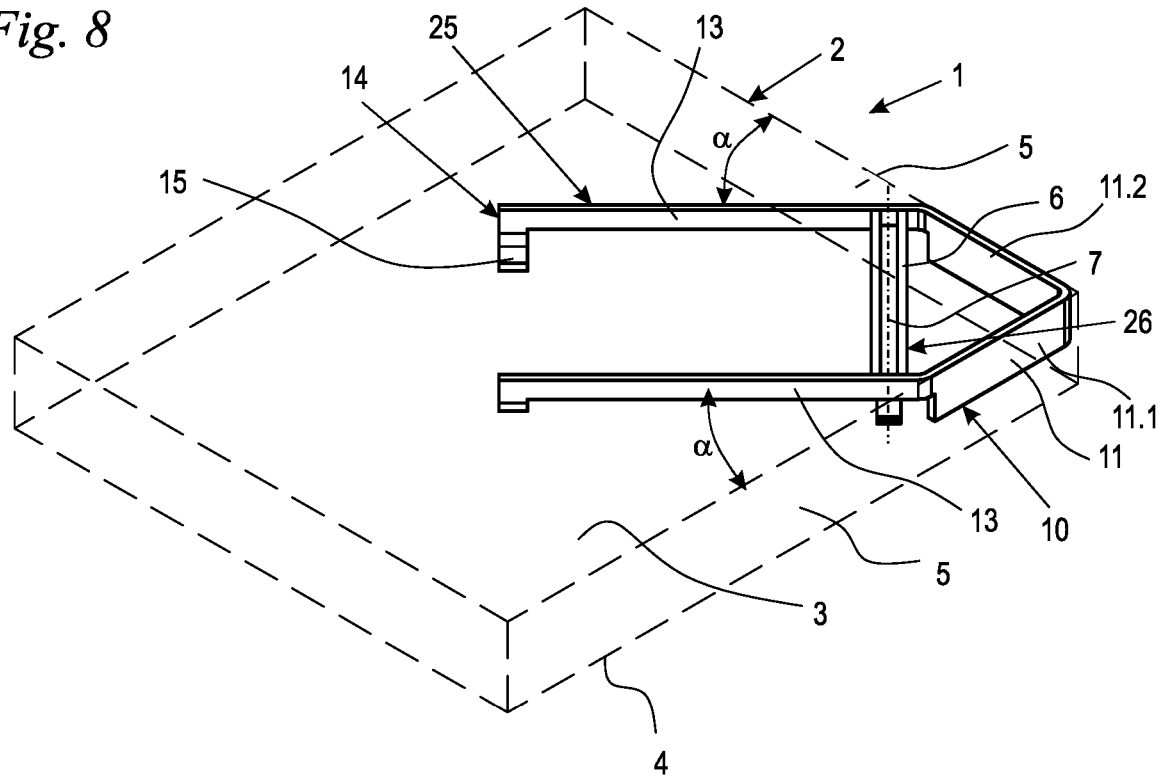
FIG. 8 is a schematic, perspective illustration of a further embodiment of a concrete construction element.
Figure 9:
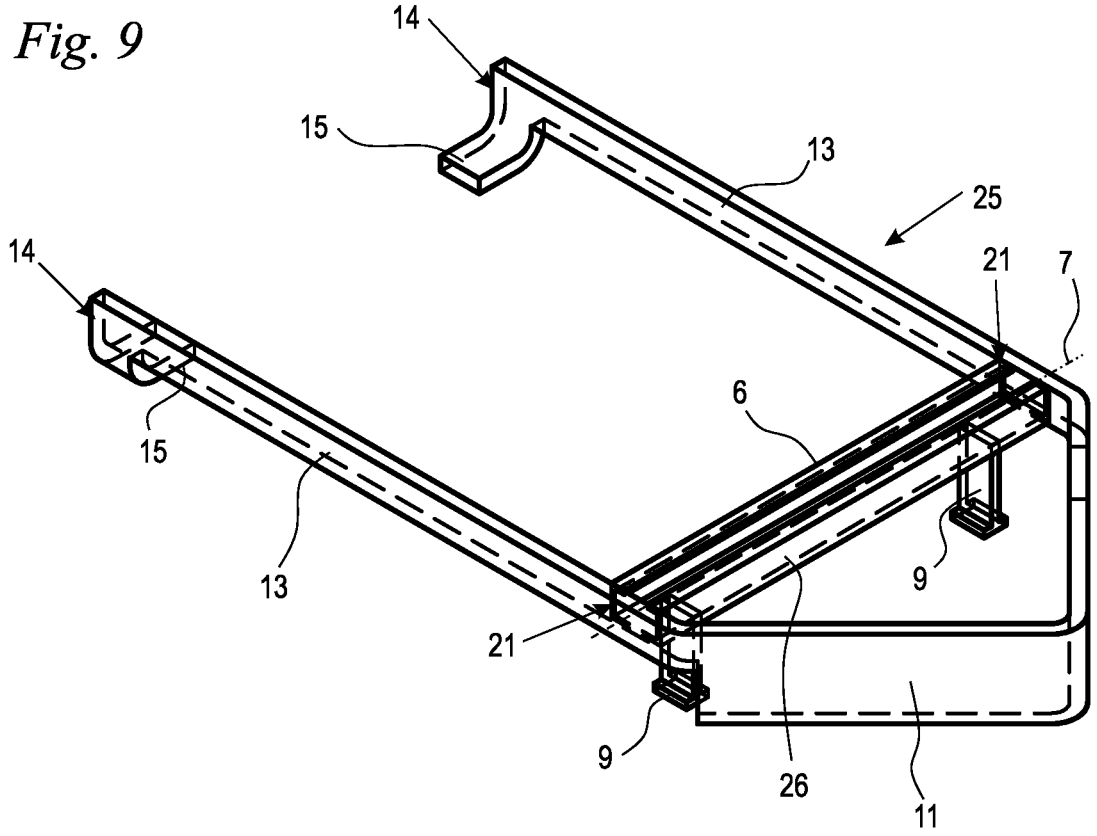
FIG. 9 is a perspective illustration of the reinforcement arrangement of the concrete construction element of FIG. 8.

FIGS. 8 to 12 show a further embodiment of a reinforcement arrangement 25. In all Figures, same reference characters in this context identify elements that correspond to each other. FIG. 8 shows the reinforcement arrangement 25 schematically in a concrete base body 2. The concrete base body 2 and the reinforcement component 25 form a concrete construction element 1. The concrete base body 2 comprises two end faces 5 which adjoin each other at a right angle in the embodiment. The reinforcement arrangement 25 comprises a reinforcement component 10 with a plate 11. The plate 11 is bent at a right angle in the embodiment. A first section 11.1 of the plate 11 is arranged at one of the end faces 5 and a second section 11.2 of the plate 11 at the other one of the two end faces 5. The sections 11.1 and 11.2 extend in the embodiment flush at the end faces 5 and have no distance relative to the end faces 5. Due to the configuration of the plate 11 with two angularly arranged sections 11.1 and 11.2, the arrangement of the plate 11 at a corner of the concrete base body 2 is possible. The anchors 13 project at an angle $\alpha$ of less than 90° relative to the end faces 5 into the concrete base body 2. In the embodiment, the angle $\alpha$ amounts to 45°. It is also possible to have different angles $\alpha$ between the anchors 13 and the respectively correlated end faces 5.

As shown in FIGS. 9 to 12, the configuration of the anchor rail 6 corresponds to the configuration of the anchor rail 6 of the preceding embodiments. The configuration of the anchors 13 with the anchoring sections 15 corresponds also to the preceding embodiments. The plate 11 and the two anchors 13 are configured together as one piece and form the reinforcement component 10. In the embodiment, the plate 11 and the two anchors 13 are embodied together of flat material. Advantageously, the plate 11 and the two anchors 13 are designed together as a bent sheet metal part. The anchors 13 are advantageously fixedly connected to the anchor rail 6 at the ends 21 of the anchor rail 6, for example, by a welding process. However, it can also be provided that the reinforcement component 10 and the anchor rail 6 are placed loosely into the formwork for the concrete construction element 1 during manufacture and are connected to each other only by means of the poured-in concrete of the concrete base body 2.

Figure 10:
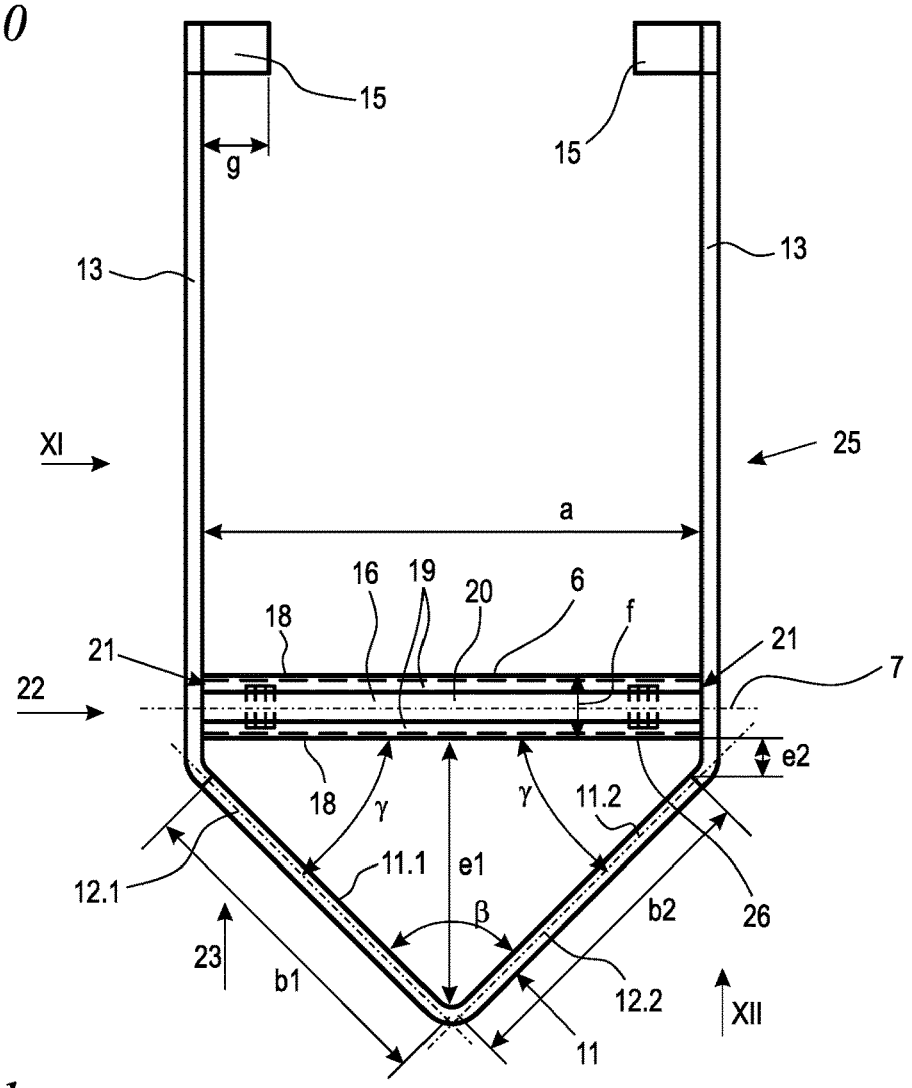
FIG. 10 is a plan view of the reinforcement arrangement of FIG. 9.

FIG. 10 shows the configuration of the plate 11 in detail. The plate 11 comprises in the first section 11.1 a longitudinal center axis 12.1 and in the second section 11.2 a longitudinal center axis 12.2. The sections 11.1 and 11.2 in the embodiment are positioned at an angle $\beta$ which amounts to 90°. The longitudinal center axes 12.1 and 12.2 are positioned relative to the longitudinal center axis 7 of the anchor rail 6 at an angle $\gamma$ that is less than 90°. An angle $\gamma$ of 30° to 60° is considered advantageous, in particular an angle $\gamma$ of approximately 45°. The first section 11.1 has a length b1 and the second section 11.2 has a length b2. In the embodiment, the two lengths b1 and b2 are of the same size. The lengths b1 and b2 are selected such that the desired angle $\gamma$ is provided between the two sections 11.1 and 11.2. Due to the angled position of the sections 11.1 and 11.2 relative to the longitudinal center axis 7 of the anchor rail 6, the distance between the plate 11 and the anchor rail 6 changes across the length of the anchor rail 6. In the region in which the two sections 11.1 and 11.2 meet each other, the plate 11 has a maximum distance e1 relative to the anchor rail 6. The distance e1 is significantly larger than the width f of the anchor rail 6. Preferably, the distance e1 amounts to a multiple of the width f of the anchor rail 6. In the region of the ends 21 of the anchor rail 6, the plate 11 has a distance e2 from the anchor rail 6. The distance e2 amounts advantageously to less than twice the width f of the anchor rail 6. In the embodiment, the distance e2 is smaller than the width f of the anchor rail 6. The distance e1 as well as the distance e2 advantageously amount to 50% to 500% of the width f.

The plate 11 and the anchor rail 6, together with the sections of the anchors 13 extending between the plate 11 and the anchor rail 6, frame the section of the concrete base body 2 arranged between plate 11 and anchor rail 6. External forces which are acting on the concrete framed by the plate 11 and the anchor rail 6 are introduced through the anchors 13 and the anchoring sections 15 into the concrete base body 2.

Figure 11:
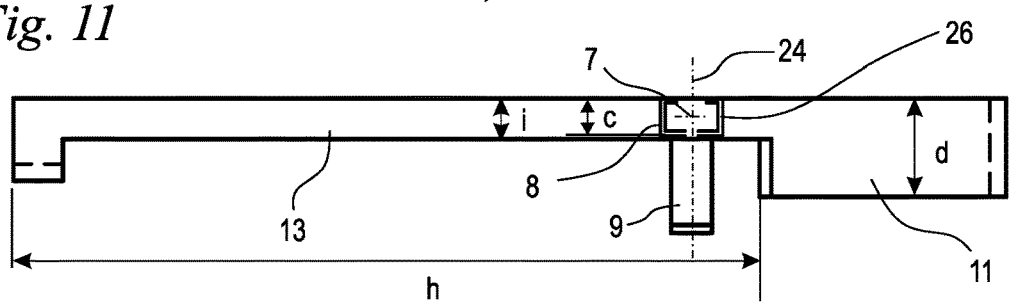
FIG. 11 is a side view of the reinforcement arrangement of FIG. 10 viewed in the direction of arrow XI in FIG. 10.
Figure 12:
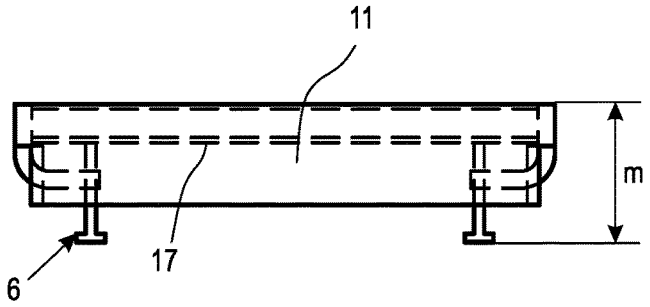
FIG. 12 is a side view of the reinforcement arrangement of FIG. 10 viewed in the direction of arrow XII in FIG. 10.

As shown in FIGS. 10 and 11, the anchor rail 6 comprises a longitudinal side 26 facing the plate 11. The longitudinal side 26 extends in the embodiment at an angle relative to the end faces 5, as shown in FIG. 8. The anchoring sections 15 form an undercut in the direction toward the plate 11, i.e., in the direction perpendicular to the longitudinal side 26. In the embodiment, the anchors 13 completely cover the interior 16 of the anchor rail 6 in the viewing direction 22 in the longitudinal direction 7 of the anchor rail 6. In the embodiment, the plate 11 covers the anchor rail 6 in the viewing direction 23 perpendicular to the longitudinal side 26 across its entire length a, as shown in particular in FIG. 12. The plate 11 covers the rail base body 8 across its entire height c. The height d of the plate 11 in the embodiment is larger than the height c of the rail base body 8. In the viewing direction 23, the rail anchors 9 are also partially covered by the plate 11, as shown in FIG. 12. The further dimensions of the plate 11 and of the anchor rail 6 corresponds advantageously to those of the preceding embodiments.

In the embodiment according to FIGS. 8 to 12, at least one additional anchor 13', not illustrated in the Figures, can be provided also which is preferably fixed to the plate 11.

The specification incorporates by reference the entire disclosure of German priority document 20 2019 005 047.7 having a filing date of Dec. 11, 2019.

While specific embodiments of the invention have been shown and described in detail to illustrate the inventive principles, it will be understood that the invention may be embodied otherwise without departing from such principles.

What is claimed is:

1. A concrete construction element comprising:

a concrete base body comprising at least one flat side and an end face;

at least one anchor rail embedded in the concrete base body;

at least one reinforcement component comprising a plate embedded in the concrete base body at a side of the at least one anchor rail which is facing toward the end face of the concrete base body;

wherein the at least one reinforcement component comprises at least two anchors fixedly connected to the plate, wherein the at least two anchors extend away from the plate to a side of the at least one anchor rail which is facing away from the plate;

wherein the at least two anchors each comprise an end facing away from the plate, wherein the end comprises at least one anchoring section, wherein the at least one anchoring section forms an undercut in a direction toward the plate such that concrete is located between the at least one anchoring section and the end face in a direction perpendicular to the end face.

2. The concrete construction element according to claim 1, wherein the plate and the at least two anchors are formed together as one piece.

3. The concrete construction element according to claim 1, wherein the at least two anchors together with the at least one anchoring section, respectively, are formed of flat material.

4. The concrete construction element according to claim 1, wherein the at least one anchor rail has a first end and a second end, wherein a first one of the at least two anchors extends at the first end of the at least one anchor rail and wherein a second one of the at least two anchors extends at the second end of the at least one anchor rail.

5. The concrete construction element according to claim 1, wherein the at least one anchor rail comprises an interior and wherein at least one of the at least two anchors is arranged at an end of the at least one anchor rail and at least partially covers the interior at said end of the at least one anchor rail.

6. The concrete construction element according to claim 1, wherein the at least one anchor rail comprises a longitudinal side facing the plate and wherein the plate at least partially covers the anchor rail, in a viewing direction perpendicular to the longitudinal side of the at least one anchor rail, across at least 50% of a length of the at least one anchor rail.

7. The concrete construction element according to claim 1, wherein the at least one anchor rail comprises a rail base body and at least one rail anchor secured to the rail base body, wherein the plate, in a viewing direction perpendicular to a longitudinal side of the at least one anchor rail, covers the rail base body across at least 50% of a height of the rail base body.

8. The concrete construction element according to claim 7, wherein the plate covers at least partially the at least one rail anchor, in the viewing direction perpendicular to the longitudinal side of the at least one anchor rail.

9. The concrete construction element according to claim 1, wherein the plate covers at least partially the at least one anchoring section in a viewing direction perpendicular to a longitudinal side of the at least one anchor rail.

10. The concrete construction element according to claim 1, wherein the plate and the at least two anchors are formed together as one piece, wherein the at least one reinforcement component is connected to the at least one anchor rail by a connection that is independent of a connection provided by the concrete of the concrete base body.

11. The concrete construction element according to claim 10, wherein the at least one reinforcement component and the at least one anchor rail are formed together as one piece.

12. The concrete construction element according to claim 1, wherein the plate is embedded in the concrete base body at a distance of less than 20 mm from the end face.

13. The concrete construction element according to claim 1, wherein a longitudinal direction of the plate extends parallel to a longitudinal direction of the at least one anchor rail.

* * * * *